United States Patent [19]

Weinman

[11] Patent Number: 4,570,797

[45] Date of Patent: Feb. 18, 1986

[54] ADHESIVE TAPE CARRIER FOR PURSE OR POCKET AND METHOD FOR MAKING SAME

[76] Inventor: Milton Weinman, 5532 S. Shore Dr., Chicago, Ill. 60637

[21] Appl. No.: 680,076

[22] Filed: Dec. 10, 1984

[51] Int. Cl.[4] ..... B65D 83/08

[52] U.S. Cl. ..... 206/447; 206/460; 206/472; 206/820

[58] Field of Search ..... 206/447, 460, 472, 820, 206/102

[56] References Cited

U.S. PATENT DOCUMENTS

| | | | |
|---|---|---|---|
| 1,840,757 | 1/1932 | Watkins | 206/526 |
| 2,289,028 | 7/1942 | Manko | 206/449 |
| 2,547,779 | 4/1951 | Renyck | 206/472 |
| 2,595,112 | 4/1952 | Story | 206/460 |
| 2,797,801 | 7/1957 | Bishop, Jr. | 206/447 |
| 3,136,679 | 6/1964 | Bender | 206/449 |
| 3,424,305 | 1/1969 | Ridland | 281/33 |
| 3,503,835 | 3/1970 | Hermann | 206/460 |
| 3,568,829 | 3/1971 | Brady, Jr. | 206/447 |
| 3,583,358 | 6/1971 | Hanson, Jr. | 206/447 |

FOREIGN PATENT DOCUMENTS

| | | | |
|---|---|---|---|
| 194170 | 2/1938 | Switzerland | 206/472 |
| 589611 | 6/1947 | United Kingdom | 206/447 |

*Primary Examiner*—William Price
*Assistant Examiner*—Brenda J. Ehrhardt
*Attorney, Agent, or Firm*—Wallenstein, Wagner, Hattis, Strampel & Aubel, Ltd.

[57] ABSTRACT

A portable carrier for adhesive tape, comprising a plurality of side-by-side support strips each having an adhesive tape strip releasably secured thereto. The support strips are detachably secured to a base portion, and several of these base portions may be arranged in juxtaposed relationship to one another so that the carrier will be of a convenient, compact substantially flat configuration. A further aspect of the invention is a method for the manufacture of such a carrier.

1 Claim, 9 Drawing Figures

ADHESIVE TAPE CARRIER FOR PURSE OR POCKET AND METHOD FOR MAKING SAME

DESCRIPTION

1. Technical Field

The invention relates to an adhesive tape carrier of a size such that it can be easily stored or carried in a pocket or purse of a user, and to a method for making such a carrier.

2. Background Prior Art

Pressure sensitive adhesive tapes are well-known, convenient and oftentimes, indispensible, items found in most homes and workplaces. Such tapes may be clear, such as the familiar Scotch TM brand tape, or opaque, as for example masking tape. Typically, the tape is wound on a roll that is supported on a dispenser which includes a serrated edge to facilitate cutting the tape to a desired length. The size of such dispensers will vary with the diameter of the roll. Although such dispensers are compact enough for the typical residential or commercial workplace, they are cumbersome and cannot be conveniently carried in a purse or pocket. Further, the serrated cutting edge is sharp and would, if thusly carried, tend to tear or snag the material of which the purse or pocket is made.

Removing the roll from its prior art dispenser does not solve the problem in that the width and diameter of the roll is still substantially the same as that of the roll-dispenser combination. It creates an additional problem in that it eliminates the means for cutting the tape to a desired length.

In accordance with the present invention, an adhesive tape carrying article is provided which is compact, light in weight, and can be easily and conveniently carried in a pocket or purse. While being of a size which is smaller than the hand of a user, the article provides a ready and ample supply of tape, desirably pre-cut to a predetermined length, for performing substantially any function for which an adhesive carrying tape is used, including everything from repairing a torn page of a book to the temporary repair of a broken finger nail. The article has no abrasive or sharp edges, and can be carried in the pocket or purse of a user for a prolonged period under widely varying temperature and humidity conditions without any adverse effect on the article itself or the adhesive tape carried by it.

SUMMARY OF THE INVENTION

The article of this invention, in brief, comprises a plurality of support strips arranged in side-by-side relation to one another, each of the strips having a pre-cut strip of adhesive tape releasably secured to a surface thereof. The support strips are detachably secured to a base portion, as by perforations, and a plurality of the base portions advantageously are arranged in face-to-back or juxtaposed relationship to one another so that the carrier will be of a convenient, substantially flat configuration. Removal of the tape strips may be facilitated by their overlapping extension beyond the periphery of one end of the support strips. The juxtaposed base portions desirably are inserted in a cover including a front portion, a back portion, a center portion, and a lip portion, and the base portions are typically held within the cover by fastening means, such as, for example, a staple extending through the upturned lip portion, base portions, and back portion. An end of the front portion may be tucked between the lip portion and the outermost base portion so as to secure the cover in a closed position. In accordance with the method aspects of the invention, the adhesive tape carrier may be manufactured by first scoring a substantially rectangular backing sheet in a first scoring step so as to provide the sheet with longitudinally-spaced apart, transversely extending slits. The backing sheet is then overlaid with a pressure sensitive, adhesive-covered side of a layer of a plastic film, typically formed of polyethylene, to provide a composite sheet. In a second scoring step, the composite sheet is divided into a plurality of panels or plates, each of the panels or plates including the support strips made from the backing sheet and adhesive tape strips made from the layer of adhesive coated plastic film. The adhesive tape strips overlay the support strips and are releasably secured thereto. To permit portability of a plurality of the support strips and tape strips in a compact, lightweight, substantially flat package, several of the plates advantageously are secured within a cover. The present carrier also may be used for electrical tapes, masking tapes, sealing tapes, and edging tapes. Double-coated tape can be made, in which the overlaying film is coated on both sides with the pressure sensitive adhesive, and a release coated backing layer is provided for one of the adhesive layers.

BRIEF DESCRIPTION OF SEVERAL VIEWS OF DRAWINGS

DETAILED DESCRIPTION

Figure 1:
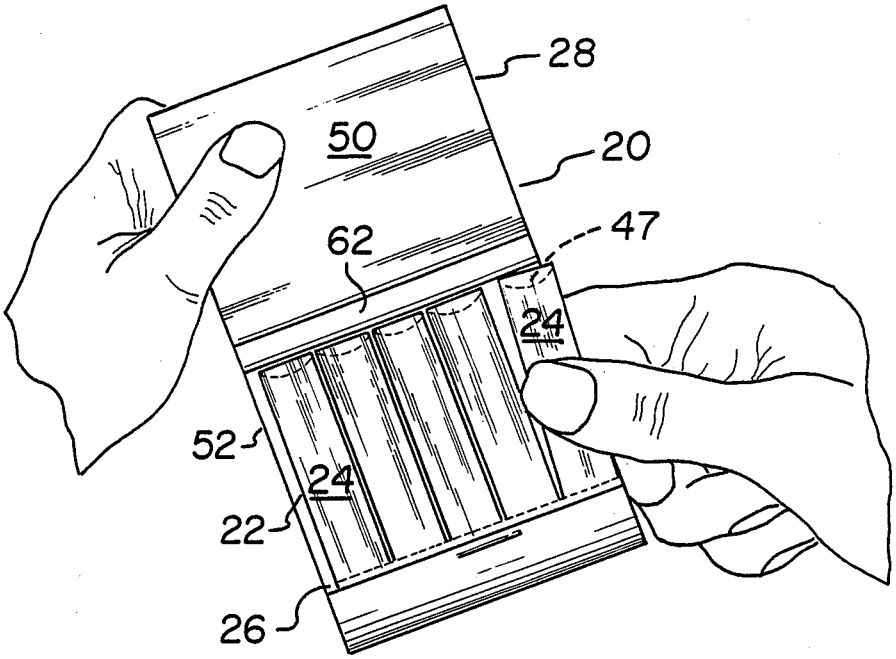
FIG. 1 is a perspective view of a preferred embodiment of the portable adhesive tape carrier, shown with its cover in an open position.
Figure 2:
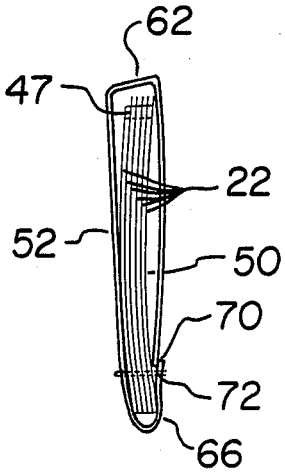
FIG. 2 is an edge view of the carrier of FIG. 1, but with its cover in a closed position, and showing a plurality of plates in juxtaposed or face-to-back configuration.

Referring now to the drawings, the numeral 20 designates a preferred embodiment of the adhesive tape carrier of the invention. In FIG. 1, the carrier 20 includes one or more panels or plates 22, each plate comprising a plurality of side-by-side, abutting support strips 24 each detachably secured to and integral with a base portion 26. Typically, a plurality of these plates 22 are juxtaposed, or placed in face-to-back relationship, so as to increase the number of support strips 24 in a given carrier. FIG. 2, for example, shows five juxtaposed plates within the carrier.

The plates 22 may be enclosed in a cover 28 formed of paperboard, card stock, or the like, the surface of which is generally smooth and often polished and printed with decorative material or advertising script.

Figure 3:
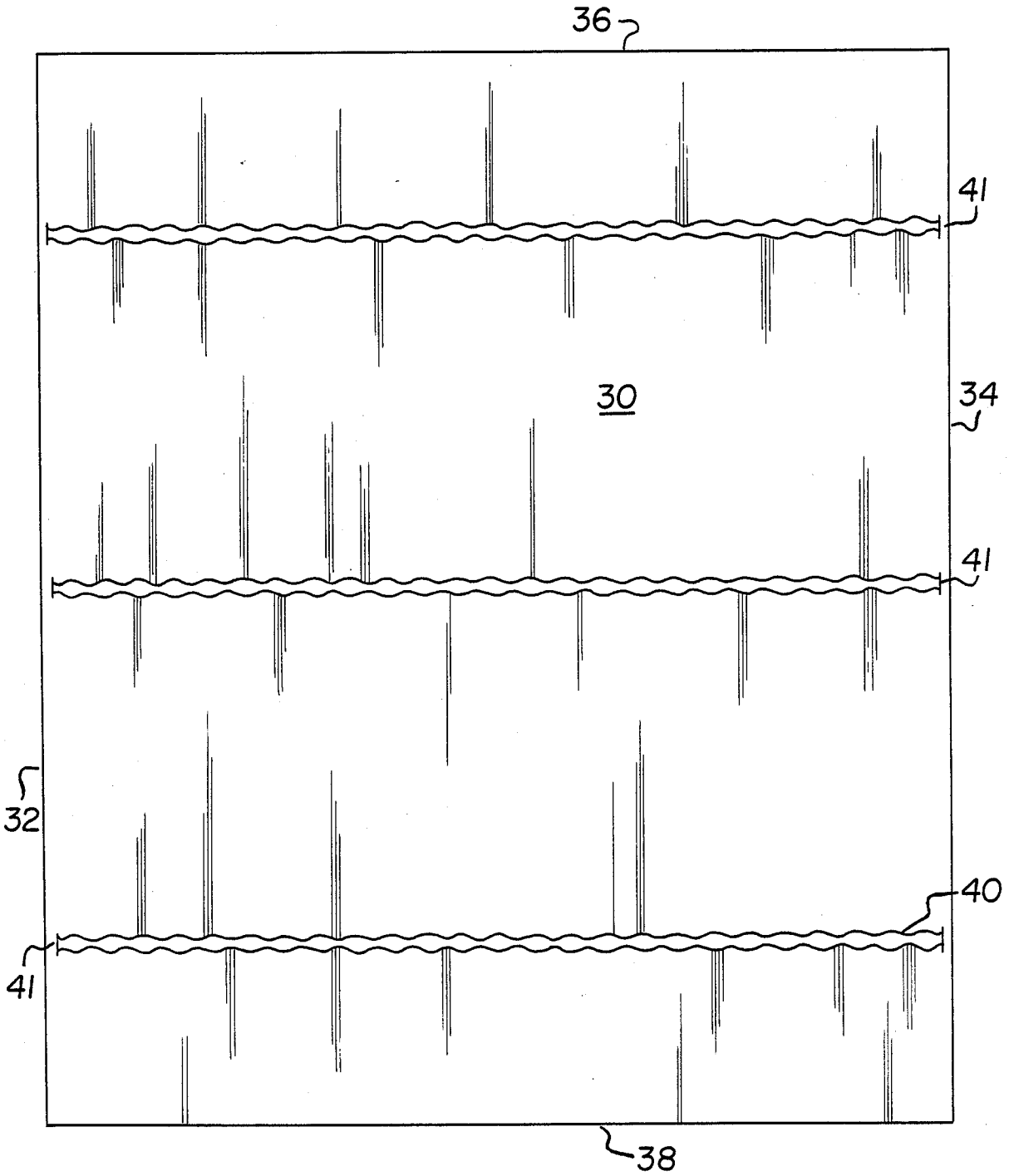
FIG. 3 is a plan view of the backing sheet used in the manufacture of the support strips after a first scoring step that cuts longitudinally spaced-apart transversely extending slits into the sheet.

Referring to FIG. 3, the support strips 24 may be manufactured from a flat substrate layer, preferably comprising a backing sheet 30 including two free lengthwise edges 32, 34 and two widthwise edges or dimensions 36, 38. The backing sheet may be either flexible or rigid, and typically will have the characteristics of "release" paper, as will be explained below.

Longitudinally spaced-apart, transversely extending slits 40 are die cut into the sheet in a first scoring step, and the slits will extend across substantially the entire width of the sheet. The slits are formed by dies having a scalloped configuration so as to result in a slit having a shape similar to that shown in FIG. 3; that is, the slit appears to be essentially formed by a series of side-by-side oval aperture-like cuts in the sheet, each aperture having an overlapping border with its adjacent apertures. By leaving a web 41, that is, a small, uncut portion of sheet material between the disparate ends of each slit 40 and each adjacent free lengthwise edge 32, 34, backing sheet 30 remains in one piece so as to facilitate further operations. It will be hereinafter seen that this first scoring step provides, in a single operation, a transverse cut permitting both the overlayment of a film layer onto a one-piece backing sheet and for the formation of a series of thumb cut-outs facilitating removal of the tape strips from the backing strips.

Figure 4:
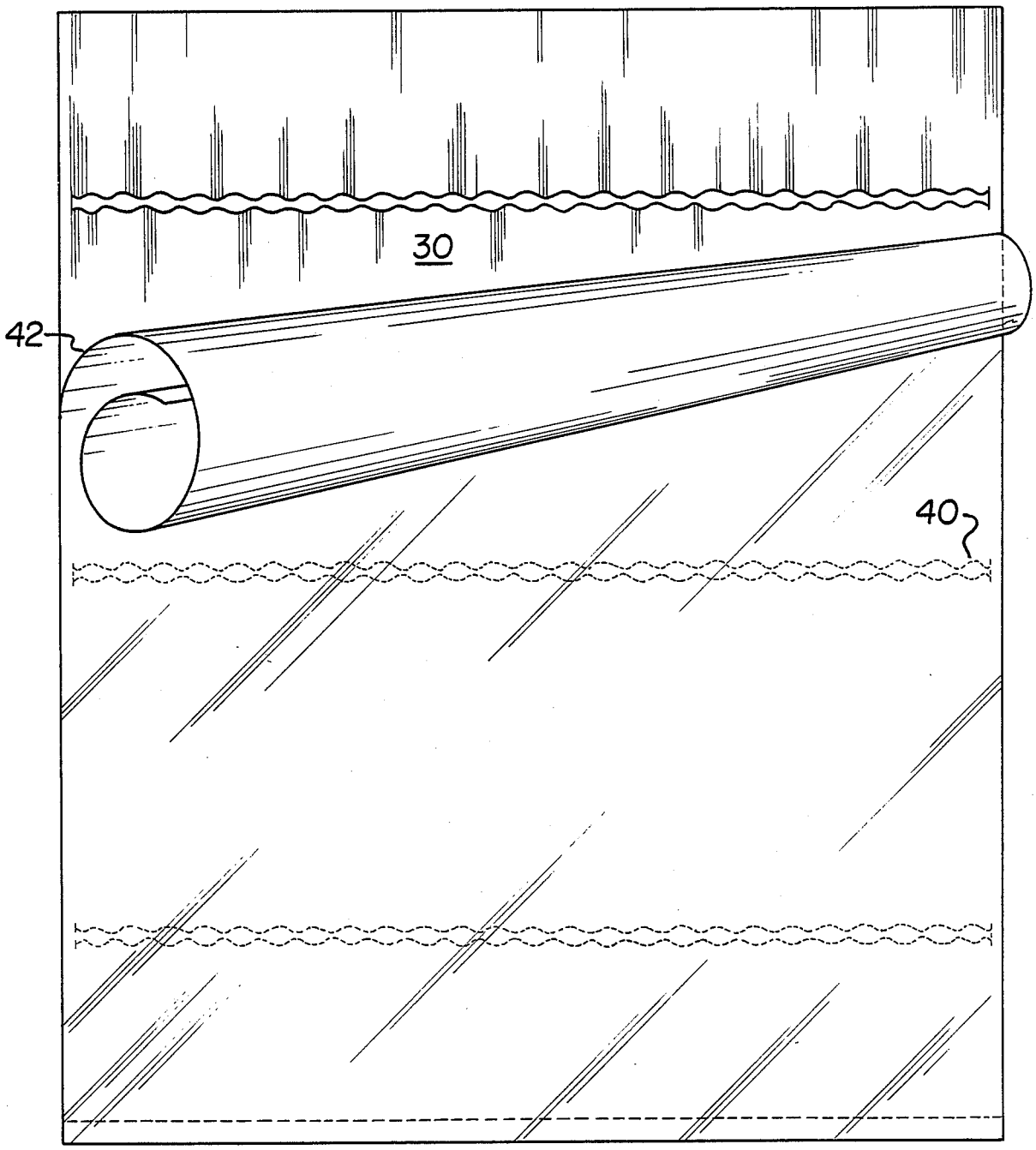
FIG. 4 is a plan view of the substrate of FIG. 3 while being overlayed with a layer of plastic film having a pressure sensitive adhesive on one side thereof so as to form a composite sheet.

A layer of film 42 having a pressure sensitive adhesive on one side thereof is overlayed (FIG. 4) upon the entire backing sheet 30, including slits 40, with the adhesive-covered side facing the backing sheet. It should be understood that the adhesive-covered film described herein may be transparent or opaque, colorless or colored, and may be of any sheet material, such as polyethylene or other plastic sheet material, useful for the manufacture of adhesive tape. A preferred material is polyethylene.

Because the backing sheet 30 has the characteristics of a release paper, the adhesive-backed polyethylene film may be easily pulled away from that sheet without leaving adhesive thereon. A suitable backing sheet may be produced, for example, by applying upon a substrate a polysiloxane-based release coating. Thus, the adhesive-covered polyethylene film that has been removed from the backing sheet 30 will be substantially as tacky and usable as it was before its overlayment on the sheet. The use of the term "release paper" herein should not be construed as meaning that the backing sheet be made of a paper, or paper-like material, of any kind. Alternatively, it will be plain to those skilled in the art that if the film is a pressure sensitive adhesive-covered film similar to that used to manufacture Magic Tape TM, a product of the 3M Company, St. Paul, Minn., which may be secured to nearly any surface including conventional paper and be removed therefrom without loss of adhesive, the support strips may then be made of virtually any material.

Figure 5:
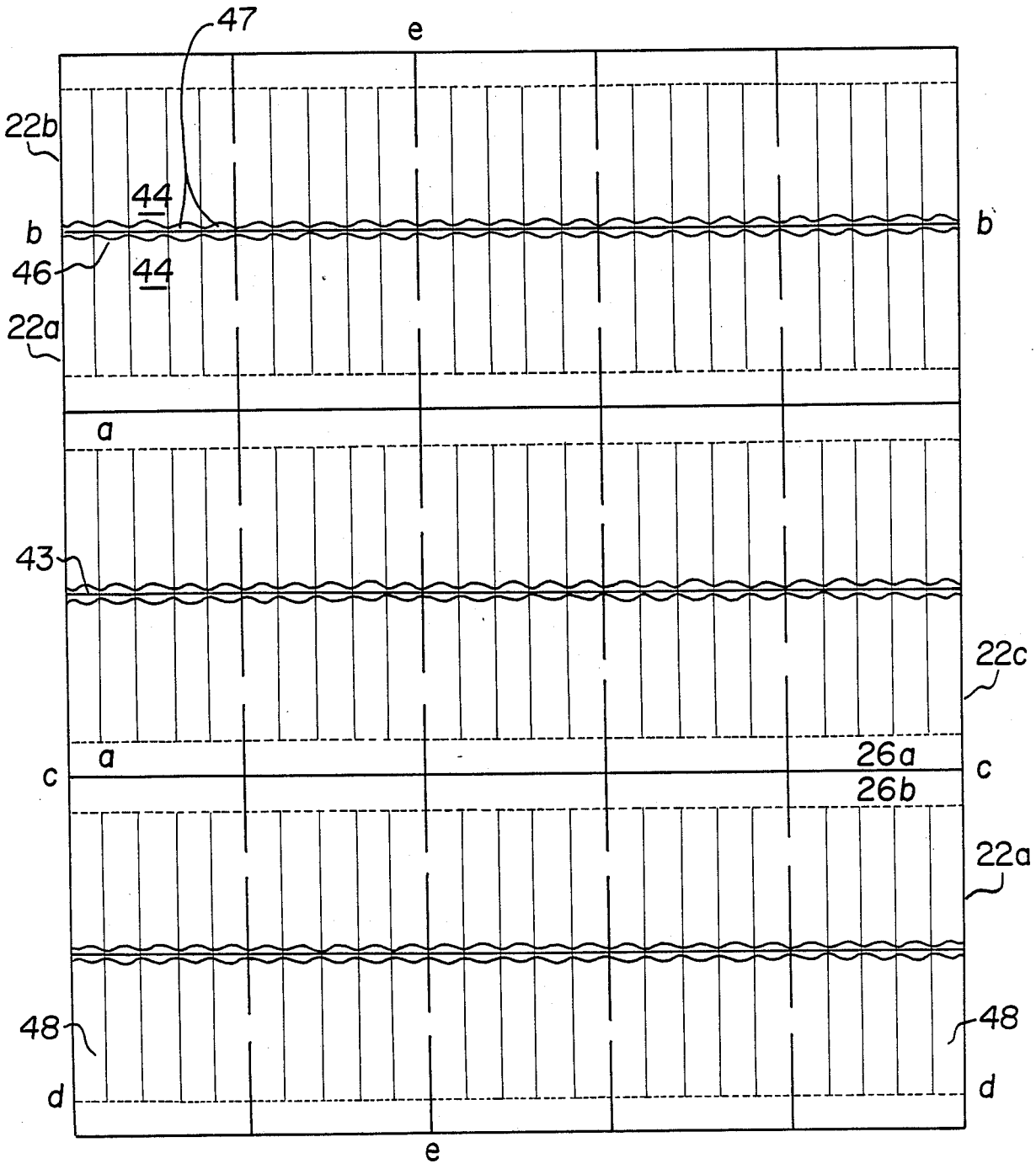
FIG. 5 is a plan view of the composite sheet of FIG. 4 after completion of a second scoring step.

The overlayed backing sheet or composite sheet is cut in a second scoring step so as to result in the sheet depicted in FIG. 5. In this Figure, the die cuts severing the composite sheet through both the film and the backing sheet are shown as solid longitudinal and solid transverse lines. Longitudinal cuts, as for example along line a—a, form the composite sheet into separate, side-by-side, abutting support strips made from the backing sheet material and side-by-side tape strips 43 releasably secured to the support strips and made from the polyethylene film. This longitudinal cut does not sever the base portion but rather leaves it intact so that one or more support strips may be detached from the base portion without affecting the integrity of the overall plate.

In the present embodiment, the longitudinal spacing of the several slits 40 and the die configuration used in the second scoring step combine to provide plates of a uniform size. It should be understood that these parameters may be varied so as to result in plates and support strips of various sizes and lengths to accommodate tape strips of various sizes and lengths. It should be further understood that in this manner one of the present carriers may be made in a form suitable for carrying tape strips of various preselected sizes and lengths.

A transverse cut through the polyethylene film and any underlying backing sheet along a line through the approximate center of the oval apertures, as for example along line b—b, separates the adjacent head ends 44 of support strips on two facing plates, such as **22*a* and 22*b*, and leaves the tape strips extending beyond the curved periphery 46 of the head end that defines a portion of the thumb cut-outs 47 so as to permit grasping and easy removal of the tape strips from the support strip. The substantially oval aperture-like cuts forming the several slits enable the user to place his thumb or finger at the thumb cut-outs 47** adjacent the head end and grasp the tape strip at a point where there is no support strip backing.

Other cuts separate longitudinally adjacent plates, such as **22*c* and 22*d*, along their respective abutting base portions, as, for example, at line c—c separating base portions 26*a* and 26*b*, so that the overlayed sheet is divided into six rows of five side-by-side plates each having five support strips. Another cut in this second scoring step perforates but does not sever the plates along, for example, line d—d extending between the base ends 48 of the support strips and the base portions to facilitate detachable removal of an individual tape-covered support strip from the plate. A further cut, shown by the four dashed longitudinal lines of FIG. 5**, as for example along line e—e, effects a partial separation of transversely adjacent plates.

Figure 6:
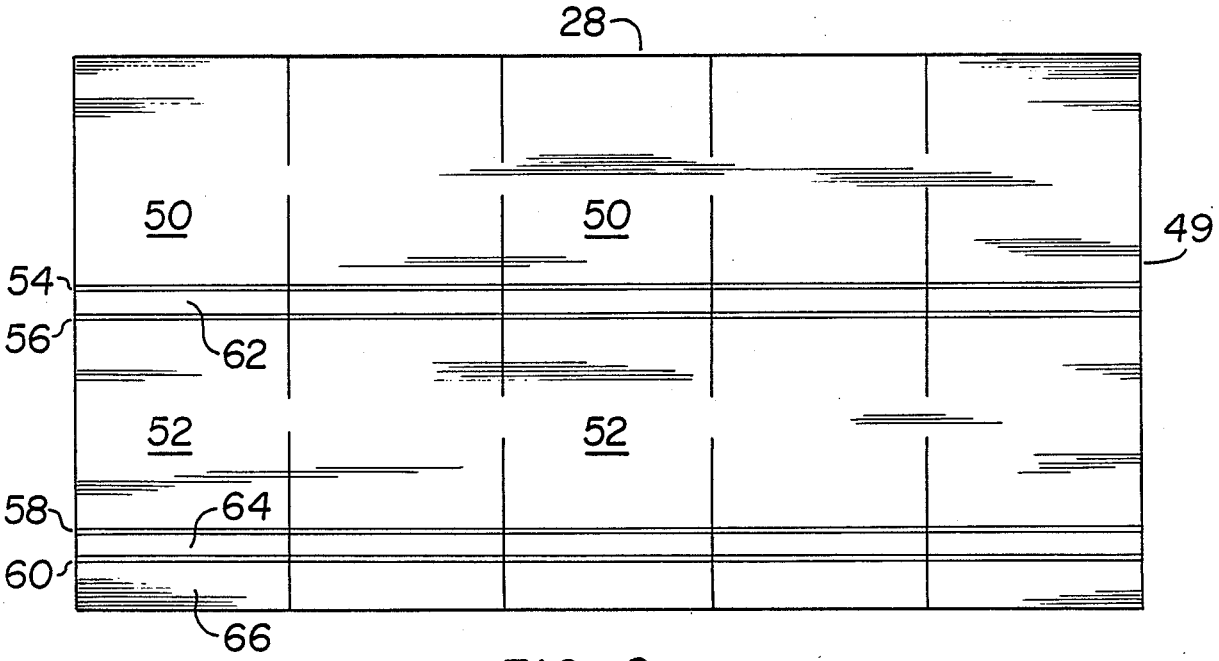
FIG. 6 is a plan view of a blank for producing five covers for the present carrier in a flat, unfolded, and uncut state and prior to insertion of the plates therein.
Figure 8:
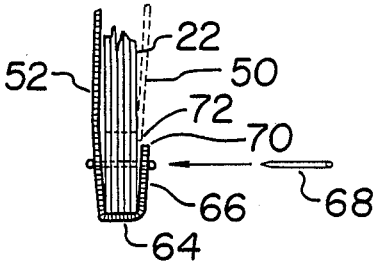
FIG. 8 is an edge view along a lower left portion of FIG. 7, with the front portion of the cover (depicted in dotted lines) as normally inserted in the upturned lip portion of the cover to close the carrier.

FIG. 6 illustrates a blank 49 for the manufacture of five (5) covers 28 in a side-by-side arrangement and for receiving at least a corresponding number of plates arranged in side-by-side relation. Each cover comprises a front portion 50, a back portion 52, four longitudinally spaced and transversely extending score lines or fold lines 54, 56, 58, 60, center portion 62, lower portion 64, and lip portion 66. Fold lines 54 and 56 define the extremities of the center portion 62 merging into the front 50 and back portions 52 and along which the cover may be folded. Fold lines 58 and 60 define the extremities of lower portion 64 merging into the back 52 and lip portions 66 and along which the cover may also be folded so as to more easily receive a plurality of plates juxtaposed on one another within the U-shaped receptacle formed by the back portion, lower portion, and lip portion, as shown in FIG. 8.

Figure 7:
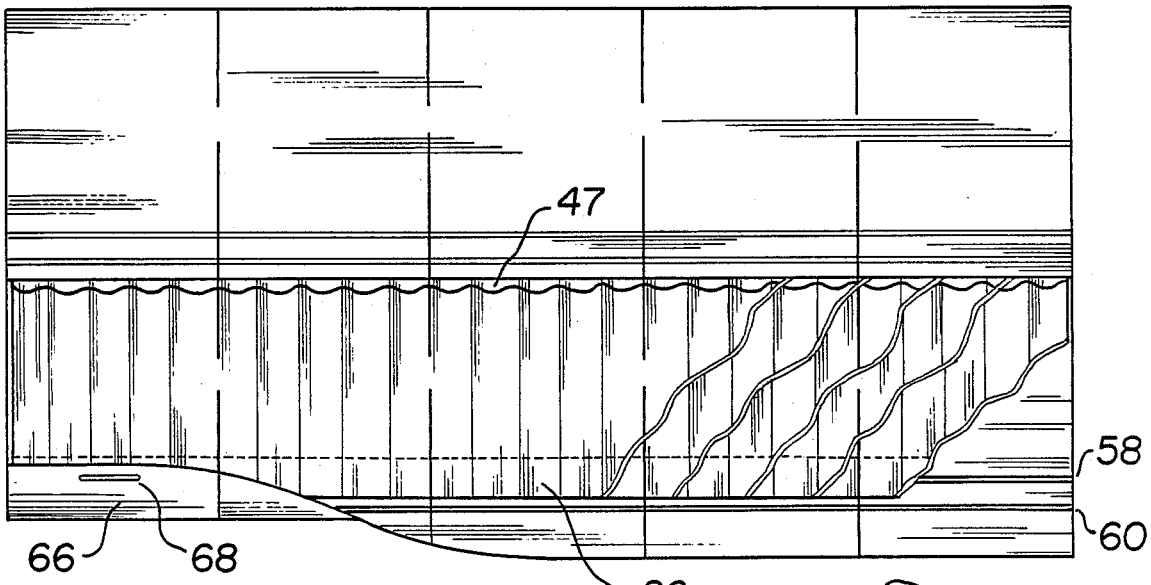
FIG. 7 is a partially-sectioned plan view showing placement of the plates within the covers of FIG. 6 and also showing the upturning of the lip portion of one of the covers over the base portions of a plate so as to place the lip portion in overlapping relationship with the base portions and further so as to permit their securing within the cover with a staple.

Referring now to FIG. 7, a row of plates is placed in the covers of FIG. 6 so that the lower edge of the base portions is between fold lines 58 and 60. Lip portion 66 is turned upwardly so as to overlap the base portions, as shown at the left of FIG. 7. The partially sectioned view of FIG. 7 indicates that five juxtaposed rows of five side-by-side plates, each plate including five support strips, are placed within the adjacent uncut covers, so that after the covers are cut apart, each of the five portable adhesive tape carriers will contain twenty-five tape strips on twenty-five support strips. A fastening means, such as a staple 68, is inserted through the upturned lip portion, juxtaposed plates, and back portion so as to retain the plates in place within the cover. After the covers and their enclosed plates have been cut apart to form the finished carrier of FIGS. 1 and 2, the front portion 50 can be hinged forward along the center portion 62. Inasmuch as the staple 68 is secured through the upturned lip portion 66 a spaced distance from the free edge 70 of the lip portion, the free end 72 of the front portion 50 may be tucked between the lip portion 66 and the outermost plate in order to secure the cover in a closed position (FIGS. 2 and 8). As seen in FIG. 2, in this closed position the front portion 50 and back portion 52 lie in planes generally parallel to each other with a plurality of plates disposed between the front 50 and back portions 52 and in a plane generally parallel to the front and back portions. The center portion 62 is generally perpendicular to the front and back portions.

When it is desired to use a tape strip, the cover 28 is opened to the approximate position shown in FIG. 1 of the drawings. In this position, the front portion 50, center portion 62, and back portion 52 lie in the same plane. The user holds the open cover 28 in one hand and grasps one of the support strips 24 between his or her forefinger and thumb of the other hand in order to tear the support strip from its corresponding base portion 26.

Figure 9:
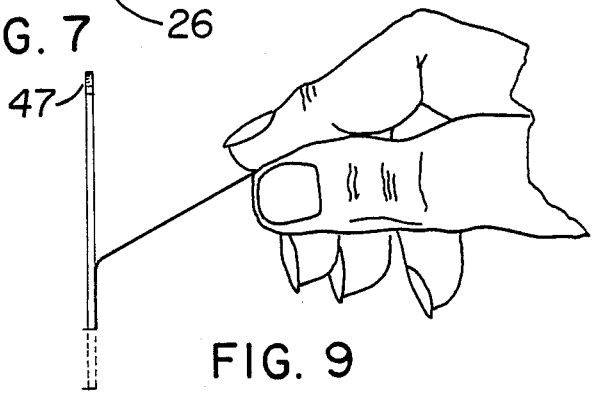
FIG. 9 is an edge view of a support strip after removal from the carrier of FIG. 1, and further showing a tape strip being downwardly removed from the support strip for use in any desired manner.

FIG. 9 illustrates an adhesive tape-covered support strip broken away from its base portion (shown in dotted lines) along the perforations. The user is shown in the process of removing the tape strip from the support strip for use as desired. The edge of the tape strip extends beyond the substantially curved periphery of the head end of the support strip, enabling the user to easily grasp an end of the tape strip at the thumb cut-out 47 so as to initiate the indicated downward removal from the support strip. Of course, if desired, the tape strip may be pulled away from the support strip while the latter is attached to its base portion and within the cover. Detaching the support strip from the base portion may be advantageous in that after a tape strip has been removed for use as desired, its support strip is empty, no longer needed, and merely obscures the tape-covered support strip in the juxtaposed plate directly behind.

The foregoing is to be considered as illustrative only of the principles of the invention. Further, since numerous modifications and changes will occur to those skilled in the art, it is not desired to limit the invention to the exact construction and method shown and described. Accordingly, all suitable modifications and equivalents may be resorted to which fall within the scope of the invention as defined in the following claims.

What I claim is:

1. A match-book type carrier for dispensing adhesive tapes of varying lengths from juxtaposed arrays of readily accessible adhesive tapes comprising:

a. a first array of supported adhesive tape strips secured to a first common base, said first array comprising a plurality of one-piece adhesive tape support strips of equal length arranged in side-by-side relation to one another, said adhesive tape support strips having a detachably secured end which is detachably secured to said first common base and a U-shaped free end; and, adhesive-backed tape strips releasably carried on one surface of each of the support strips, each of the tape strips having a coating of adhesive on the entire back surface thereof to enable the entire tape strip to be used by a user; and, each of said tape strips terminating within the U-shaped portion of the support strip to form an exposed adherent finger gripping portion contiguous with the plane formed by the backing surface of the support strip;

b. a second array of supported adhesive tape strips, said supported adhesive tape strips being of different length than the supported adhesive tape strips of the first array secured to a second common base, said second array comprising a plurality of one-piece adhesive tape support strips of equal length arranged in side-by-side relation to one another, said adhesive tape support strips having a detachably secured end which is detachably secured to said second common base and a U-shaped free end; and, adhesive-backed tape strips releasably carried on one surface of each of the support strips, each of the tape strips having a coating of adhesive on the entire back surface thereof to enable the entire tape strip to be used by a user; and, each of said tape strips terminating within the U-shaped portion of the support strip to form an exposed adherent finger gripping portion contiguous with the plane formed by the backing surface of the support strip;

c. a cover including a front portion, a back portion, a center portion merging into said front and back portions and along which said cover may be folded, a lip portion, and a lower portion merging into said lip and back portions, said cover being folded along said lower portion to form a U-shaped receptable defined by said back portion, lower portion, and lip portion within which the first and second bases are juxtaposed; and, d. fastening means for securing said first and second juxtaposed bases to said cover.

* * * * *